US006040283A

United States Patent [19]

Miner

[11] Patent Number: 6,040,283

[45] Date of Patent: Mar. 21, 2000

[54] CONCENTRATED ALKALINE GLUTARALDEHYDE-PHENOLIC DISINFECTANT

[75] Inventor: Norman A. Miner, Fort Worth, Tex.

[73] Assignee: Microchem Laboratory, Inc., Fort Worth, Tex.

[21] Appl. No.: 09/112,162

[22] Filed: Jul. 8, 1998

[51] Int. Cl.[7] ..... C11D 3/48; C11D 3/30

[52] U.S. Cl. ..... 510/161; 510/130; 510/131; 510/319; 510/382; 510/383; 510/386; 510/480; 514/693; 514/705

[58] Field of Search ..... 514/693, 705; 510/130, 131, 161, 319, 382, 383, 386, 480

[56] References Cited

U.S. PATENT DOCUMENTS

| | | | |
|---|---|---|---|
| 4,103,001 | 7/1978 | Schattner | 424/148 |
| 4,469,614 | 9/1984 | Martin | 252/106 |
| 4,748,279 | 5/1988 | Whiteley | 568/494 |
| 4,784,790 | 11/1988 | Disch et al. | 252/174.12 |
| 4,994,200 | 2/1991 | Disch et al. | 252/106 |
| 5,250,573 | 10/1993 | Magni | 514/701 |
| 5,252,606 | 10/1993 | Martin | 514/574 |
| 5,322,856 | 6/1994 | Martin | 514/574 |
| 5,696,170 | 12/1997 | Exner et al. | 514/693 |
| 5,891,922 | 4/1999 | Gaumer et al. | 514/643 |

*Primary Examiner*—Mark Kopec
*Assistant Examiner*—Charles Boyer
*Attorney, Agent, or Firm*—Zarley, McKee, Thomte, Voorhees & Sease

[57] ABSTRACT

A high level disinfectant and sterilant solution that is useful to disinfect and sterilize heat-sensitive medical, dental and veterinary devices. The disinfectant solution is a two-part system for mixing just prior to use. The first part comprises glutaraldehyde and a phenolic chemical at a concentration of from about 0.5% w/w to 2.2% w/w, and a second separately contained part that is an activated buffer form of ethylene diamine tetraacetic acid (EDTA). The third part of the system is local potable tap water.

9 Claims, No Drawings

CONCENTRATED ALKALINE GLUTARALDEHYDE-PHENOLIC DISINFECTANT

FIELD OF THE INVENTION

This invention is an improved concentrated stable alkaline glutaraldehyde-phenolic formulation intended for the high-level disinfection and/or sterilization of heat-sensitive medical, dental, and veterinary devices, at ambient conditions.

BACKGROUND OF THE INVENTION

In contrast to stainless steel surgical instruments that can be sterilized prior to use by exposing the instrument to super-heated steam under pressure at 121° C., an increasing number of medical instruments are heat-sensitive because they are constructed of plastic, fiberoptics, heat-sensitive cements and electronic components. Exposure of such instruments to heat equal to or greater than 55° C. may often destroy the instrument. Heat-sensitive endoscopes penetrate into the lungs (bronchoscopes), esophagus and stomach (gastroscopes), intestines (colonoscopes and sigmoidoscopes), peritoneal cavity (laparoscopes), joints (arthro-scopes), and many other areas of the body where the endoscopes contact blood and other body fluids. These endoscopes provide valuable minimally-invasive inspection, diagnosis and treatment of the body. During use the endoscopes may be contaminated with such serious and deadly microbes as the HIV virus, hepatitis B and C viruses, mycobacteria (TB), pathogenic bacteria, antibiotic-resistant bacteria and pathogenic fungi, for example. The most powerful highest level of disinfectants and sterilants capable of killing virtually all types of pathogenic microbes are used at ambient (18° C.–24° C.) temperatures to disinfect heat-sensitive instruments between patients.

Existing high-level liquid chemical disinfectants and sterilants have many useful properties, but depending on the chemistry may also have many limitations. The formula of this invention solves long-recognized, but unresolved needs of liquid chemical high-level disinfectants useful at ambient temperatures.

Pepper et al. (U.S. Pat. No. 3,016,328) taught that alkaline glutaraldehyde was significantly more antimicrobial than acidic glutaraldehyde. However, alkaline glutaraldehyde is less stable than acidic glutaraldehyde and loses about 40% of its concentration within 7–14 days when buffered with some alkali metal carbonates, such as sodium bicarbonate. Because of this chemical instability, glutaraldehyde was formulated at 2–3 times the concentration necessary for sterilization. This excessive concentration of glutaraldehyde exacerbates the toxic and irritating vapor properties of glutaraldehyde. The formula of this present invention uses a phosphate chemical buffer to achieve a stable alkaline glutaraldehyde that in turn allows sterilization with 50% to 75% less glutaraldehyde accompanied with less toxicity and irritation. It therefore achieves advantages and results not achieved by the Pepper U.S. Pat. No. 3,016,328.

Many scientists have published on the poor tuberculocidal activity of glutaraldehyde (S. D. Rubbo, et al.; T. Bergan, and A. Lystad; F. Collins). In response to this poor tuberculocidal activity, and in response to the instability of alkaline glutaraldehyde, glutaraldehyde formulations have contained high initial concentrations of glutaraldehyde, and directions for use have specified impractical high temperatures (25° C.) and long exposure times of 45 to 90 min. The formula of this invention includes a phenolic chemical with rapid (10–20 min.) tuberculocidal activity at practical ambient temperatures (18° C.–24° C.), therefore having advantages over the present state of the art.

Boucher (U.S. Pat. No. 3,917,850) disclosed that combinations of glutaraldehyde and phenolics were more antimicrobial than either chemical alone. The addition of phenolic chemicals to glutaraldehyde allows the mixture to be tuberculocidal within 10–20 min. at ambient temperatures and at relatively low concentrations of glutaraldehyde; however, Boucher does not contemplate a concentrated two-part system that can be effective at low temperature.

SUMMARY OF THE INVENTION

In the present invention glutaraldehyde may be concentrated at 10.0% w/w to 25.0% w/w in combination with concentrated phenolics at an acidic pH value of 3.5 to 4.5 for chemical stability, to be diluted with potable tap water, and activated with buffers from a second container to an alkaline pH value for optimum antimicrobial activity at ambient conditions.

DETAILED DESCRIPTION OF THE INVENTION

The consumer in present compositions pays for the shipment of 96.0% to 98.0% water. This cost to ship water may represent 10% to 20% of the retail cost of the disinfectant. The formula of the present invention concentrates the glutaraldehyde and phenolic chemicals at an acid pH value for stability, and concentrated for storage and handling convenience, and therefore saves the cost of shipping water. At the time of use, this formula is diluted with potable tap water, and buffered from a second container to an alkaline pH value. All of the advantages of chemical stability during warehouse storage, low shipping costs, and storage and handling convenience of concentration, and maximum antimicrobial activity during use from an alkaline pH value are realized in the formula of this invention.

Phenolic chemicals are relatively insoluble in water, and this is especially true for hard water with dissolved calcium and magnesium mineral salts. Potable tap water from different regions may have various concentrations of dissolved divalent cations that can precipitate phenolic chemicals. The formula of this invention contains ethylene diamine tetra acetate (EDTA). EDTA selectively combines with Ca++ and Mg++ cations to prevent them from precipitating the phenolic chemicals. EDTA also enhances the antimicrobial activity of phenolic chemicals. EDTA in this formula also helps to solve the problem of reconstituting the concentrate in typical potable water supplies.

Concentrated phenolics in an aqueous solution may be unstable and precipitate and/or react with other chemicals in the formula to form an undesirable brown gummy residue. Cationic and non-ionic detergents are incompatible with phenolics. Anionic detergents are compatible with phenolics, but may cause excess and undesirable foaming and/or brown residues in the concentrate. Anionic detergents may be selected for use in the present compositions that minimize foaming, and maintain a clear, stable concentrate of acidic glutaraldehyde and phenolics. Antifoam chemistries (silicone and/or non-silicone organic) can also be included in the formula or added later to give a final diluted concentration of 25 ppm to 100 ppm. Antifoams further minimize the problem of excess foaming from anionic detergents. These water insoluble antifoams come to the surface of the diluted formula and compete at the surface with glutaraldehyde to minimize the escape of irritating vapors of glutaraldehyde.

This invention provides a concentrated high-level disinfectant and sterilant solution that can be used to sterilize heat-sensitive medical, dental and veterinary devices. The formula contains a number of ingredients, each of which is important to overcome problems to provide a sterilant solution that solves long-felt, but heretofore unresolved needs in a manner not heretofore achievable.

The ingredients and the overall system design is as follows:

1. Part A contains glutaraldehyde to kill spores, bacteria, mycobacteria, fungi, and viruses at a pH value of 3.5 to 4.5 to maintain stability, and at a concentration to yield a final diluted concentration of 0.5% w/w to 2.0% w/w.
2. Part A contains a phenolic chemical at an acidic pH value, and in an organic milieu (glutaraldehyde, alcohol and detergent) to be stable, and at a concentration to provide rapid tuberculocidal activity at ambient temperatures in the final diluted formula.
3. Part A contains an anionic detergent to help solubilize the phenolic chemistry, maintain clarity, and to minimize foaming in the final diluted concentration.
4. Part A is a concentrate to be diluted by potable tap water and made alkaline for use as a high-level disinfectant or sterilant.
5. Part B contains a salt of ethylene diamine tetraacetate to keep the phenolic in solution when diluted with tap water, and to assist the tuberculocidal activity of the mixture. Other chelating agents could also be used in place of EDTA.
6. Part B contains a phosphate or other buffer system to provide a pH value of 7.0 to 8.5 for the final diluted mixture. Glutaraldehyde is stable in the buffer system.
7. Part B preferably contains trace amounts of a dye to be able to distinguish that the final formula has been mixed.
8. Part A and Part B are concentrates to be mixed with tap water to provide a final use concentration of high-level disinfectant/sterilant.

It can be seen from the above that a concentrate is formulated to be diluted with any local potable tap water to provide a high-level disinfectant and/or sterilant for use with heat-sensitive medical and other devices. Importantly the invention formulation can be used to disinfect (10–20 min.) or sterilize (6–10 hrs.) medical devices at ambient (or higher) temperatures. The active ingredients are reducing agents, and the mild alkaline pH value of 7.0 to 8.5 is compatible with the materials of medical devices including sensitive flexible and rigid lensed, electronic, endoscopes. The formula of this invention as a whole promotes chemical stability, optimizes antimicrobial activity, and minimizes the toxic and irritating fumes of glutaraldehyde. The concentration levels of the composition allow it to be stored and handled conveniently, and the formulation is designed to be reconstituted with ordinary local potable tap water. This is a convenience anywhere, and especially in remote areas, and/or in veterinary field practice.

This formula is divided into two concentrated parts, Part A and Part B. Part A is concentrated preferably about 10× (broadly from 5× to 20×). Part A concentrate contains glutaraldehyde at concentrations of 10.0% w/w to 25.0% w/w, with a preferred concentration of 15.0% w/w to 18.0% w/w. The pH value of Part A is 3.5 to 4.5. The glutaraldehyde provides sporicidal, bactericidal, tuberculocidal, fungicidal, and virucidal activity, and is chemically stable at this pH value.

Part A concentrate also contains a phenolic chemical. This phenolic can be ortho-phenylphenol, paratertiary amylphenol, ortho-benzyl-parachlorophenol, or other well-known antimicrobial modified phenols. The preferred phenolic is ortho-phenylphenol at a concentration of 0.5% to 2.2%. The preferred concentration is 1.1% w/w ortho-phenylphenol. Ortho-phenylphenol is dissolved in isopropanol or methanol or other water-miscible alcohol. Ortho-phenylphenol is chemically stable in the concentrated organic milieu (glutaraldehyde and alcohol and anionic surfactant) at the 3.5 to 4.5 pH value of Part A. Ortho-phenylphenol provides bactericidal, fungicidal, virucidal, and especially tuberculocidal activity to the formulas of this invention.

Part A contains an anionic detergent. The detergent is chosen to be relatively low-foaming. This anionic detergent can be chosen from among the following: alkyl sulfates and alkane sulfonates, linear alkyl benzene or naphthalene sulfonates, secondary alkane sulfonates, alkyl ether sulfates or sulfonates, alkyl phosphates or phosphonates, dialkyl sulfosuccinic acid esters, sugar esters (e.g., sorbitan esters) and $C_8$–$C_{10}$ alkyl glucosides. Preferred coupling agents for use in the present invention include n-octanesulfonate, available as NAS 8D from Ecolab, and the commonly available aromatic sulfonates such as the alkyl benzene sulfonates (e.g. xylene sulfonates) or naphahalene sulfonates.

A most preferred detergent is sodium olefin sulfonate at a concentration of 1.0% to 10.0% based on a 100% active solution of detergent. The preferred concentration of detergent is 2.5% w/w in the concentrate. One purpose of the detergent is to promote solubility of the ortho-phenylphenol upon dilution in tap water, and to maintain the chemical stability of the ortho-phenylphenol in the concentrate.

Part B is a 50× concentrate. Part B contains the buffer at sufficient concentration to give the final diluted disinfectant a buffered pH value of 7.0 to 8.5. A preferred buffer is sodium phosphate dibasic ($Na_2HPO_4$). The purpose of the buffer is to raise the pH of Part A to an alkaline pH value of 7.0 to 8.5 upon activation and dilution, for the sporicidal activity of glutaraldehyde. The preferred buffer is compatible with glutaraldehyde, and maintains the stability of glutaraldehyde at alkaline pH values.

Part B contains salts of ethylene diamine-tetraacetate (EDTA).

Chelating agents or sequestrants generally useful include alkyl diamine polyacetic acid-type chelating agents such as EDTA (ethylene diamine tetraacetate tetrasodium salt), acrylic and polyacrylic acid-type stabilizing agents, phosphonic acid, and phosphonate-type chelating agents among others. Preferable sequestrants include phosphonic acids and phosphonate salts including ethylene 1-hydroxy diphosphonic acid ($CH_3C(PO_3H_2)_2OH$), amino[tri(methylene phosphonic acid)] ($[CH_2PO_3H_2]_2$(ethylene diamine[tetra methylene-phosphonic acid)], 2-phosphene butane-1,2,4-tricarboxylic acid, as well as the alkyl metal salts, ammonium salts, or alkyloyl amine salts, such as mono, di, or tetra-ethanolamine salts.

The concentrated salts of part B prevent spoilage, or the growth of any bacteria or fungi in part B.

Ninety (90.0) parts of Part A are added to 890 parts of potable tap water, and 20 parts of Part B are then also added to the mixture to provide the use dilution. Different ratios or volumes of Part A and Part B could be added to tap water to provide different concentrations or final volumes (quarts or gallons, for example) of glutaraldehyde and ortho-phenylphenol in the disinfectant as finally diluted for use.

The following examples are offered to illustrate but not limit the scope of the disclosed invention.

EXAMPLE 1

In the examples, all percentages are weight percent unless otherwise indicated. Example 1 gives the presently-known best mode composition of the preferred formulas for the concentrated formulations of this invention.

TABLE 1

| Ingredients | Formulation I | Formulation II | Formulation III |
|---|---|---|---|
| Part A Concentrate: | | | |
| Glutaraldehyde | 15.0% | 14.0% | 10.0% |
| Formaldehyde | None | 1.0% | None |
| Ortho-Phenylphenol | 1.1% | 1.1% | 2.0% |
| Isopropanol | 20.0% | None | 30.0% |
| Methanol | None | 25.0% | None |
| Sodium Olefin Sulfonate | 2.5% | 3.0% | 2.5% |
| Water | Remainder | Remainder | Remainder |
| pH value | 3.5–4.5 | 3.5–4.5 | 3.5–4.5 |
| Part B Concentrate: | | | |
| Disodium Ethylene-diamine-tetra-acetate | 2.5% | 3.0% | 3.0% |
| Sodium Phosphate, dibasic | 7.0% | 6.5% | 7.5% |
| Ortho-Phenylphenol | None | 0.01% | 0.001% |
| Dye | Trace | Trace | Trace |
| Water | Remainder | Remainder | Remainder |
| pH value | 7.5 | 7.5 | 7.5 |

The formulations of Example 1 are intended as concentrates to be diluted 5 to 20-fold with potable tap water for the use-concentration. Of course, the concentrations of the ingredients may vary within the ranges of solubility and antimicrobial activity. Various alcohols may be used to dissolve the phenolics. Various phenolics may be used to give a total Part A concentration of 0.5% to 2.0% w/w. Some phenolics are more or less toxic, more or less soluble in water, and more or less antimicrobial. Various surfactants may be used, although non-ionic and cationic surfactants diminish or neutralize the antimicrobial activity of phenolics. Some anionic detergents are more or less preferred in this formulation for reasons of foaming or physical compatibility. Other aldehydes may be included in the formulation. As with phenolics, dialdehydes and monoaldehydes vary in solubility, toxicity, odor and antimicrobial activity.

Dyes, fragrances, pH indicators and corrosion inhibiting chemicals may obviously be added to this formula.

EXAMPLE 2

Example 2 compares the sporicidal activity of a ten-fold dilution of Part A of Formulation I, fifty-fold dilution of Part B, Table 1, to a 2.5% alkaline glutaraldehyde commercial brand of sterilant (Cidex-7). In the United States the official test to identify a sporicidal chemical is the Association of Official Analytical Chemists (AOAC) Sporicidal Activity of Disinfectants Test 966.04. Unglazed porcelain penicylinders (cylinders) were contaminated (labeled) with spores of Clostridium sporogenes according to the methods of the AOAC Test 966.04. The dry *C. sporogenes*-labeled cylinders were validated to carry an average of equal to or greater than $1.0\times10^6$ Colony Forming Units (CFU) per cylinder. Thirty (30) *C. sporogenes*-labeled cylinders were exposed to Formulation I or Cidex per exposure time at 20° C. for increasing exposure times from 1.0 hrs. to 6.0 hrs. This study was repeated twice, and the average results are reported in Table 2.

TABLE 2

| Sterilant | pH | Percentage of Sterile Cylinders Per Thirty (30) *C. sporogenes*-Labeled Cylinders. Exposure Time in Hrs. at 20° C. | | | |
|---|---|---|---|---|---|
| Formulation | Value | 1.0 | 2.0 | 4.0 | 6.0 |
| Formulation I Diluted 10X* | 7.2 | 72% | 92% | 98% | 100% |
| Cidex-7 | 7.5 | 92% | 97% | 98% | 100% |

*Diluted 0.9 parts of Formulation I, Part A, plus 8.9 parts of synthetic hard water (400 ppm $CaCO_3$) plus 0.2 parts of Part B.

In Table 2, Cidex-7 had a glutaraldehyde concentration of 2.5%. Formulation I diluted ten-fold with water (400 ppm hardness as $CaCO_3$) had a glutaraldehyde concentration of 1.5%, 40% less than Cidex-7. Both the diluted Formulation I and Cidex-7 had a similar profile of increasing percentage of sterile spore-labeled cylinders as a function of increasing exposure time, and both formulations sterilized 100% of the group of 30 *C. sporogenes*-labeled cylinders within 6.0 hrs. at 20° C.

EXAMPLE 3

Mycobacteria (*M. hominis* is a causative agent of tuberculosis (TB) in humans) have waxy coats that enable them to resist many water soluble germicidal chemicals such as glutaraldehyde, formaldehyde, iodines, chlorines, and quaternary ammonium compounds (QUAC). *M. bovis* var. *BCG* is the model mycobacterium used in the AOAC Confirmative Tuberculocidal Activity of Disinfectants Test 965.12. Along with sporicidal activity, tuberculocidal activity is a major indicator of the highest level of a broad spectrum disinfectant. Table 3 shows the results of a quantitative tuberculocidal activity test of Formulation I, Part A, (Table 1) diluted ten-fold with synthetic hard water (400 ppm $CaCO_3$), plus Part B, Formulation I, Part A, diluted fifteen-fold with synthetic hard water, plus Part B, and Cidex-7 at 2.5% alkaline glutaraldehyde. One million ($1.0\times10^6$) CFU of *M. bovis* var. *BCG* were exposed to the disinfectants for various exposure times at 20° C. The suspensions were then measured for surviving CFU of *M. bovis* var. *BCG*.

TABLE 3

| Disinfectant | Glutaral-dehyde Concen-tration | Surviving CFU of *M. bovis* var. BCG Exposure Time in Min. at 20° C. | | | | | |
|---|---|---|---|---|---|---|---|
| | | 1.0 | 5.0 | 10.0 | 20.0 | 30.0 | 45.0 |
| Formulation I Diluted Ten-Fold | 1.5% | 10,000 | Zero | Zero | Zero | Zero | Zero |
| Formulation I Diluted Fifteen-Fold | 1.0% | 875,000 | 5,300 | 550 | Zero | Zero | Zero |
| Cidex-7 Undiluted | 2.5% | 600,000 | 1,600 | 1,100 | 250 | 150 | 50 |

Table 3 shows that Formulation I, Part A, diluted fifteen-fold with synthetic hard water at 400 ppm $CaCO_3$ kills one million ($1.0\times10^6$) CFU of *M. bovis* var. *BCG* within 20 min. at 20° C. In Cidex-7 at its full strength of 2.5% glutaraldehyde there are still surviving cells of *M. bovis* var. *BCG* after exposure for 45 min. at 20° C.

All of the ingredients of Formulation I; glutaraldehyde, phenolics, surfactant, EDTA, and the buffer system at pH 7.3; combine to make diluted Formulation I tuberculocidal within the practical exposure of 20 min. at 20° C. The ingredients of Formulation I combine to penetrate the waxy coat, and clumps of waxy-coated cells of *M. bovis* var. *BCG*. As represented by Cidex-7, glutaraldehyde alone at higher concentrations, alkaline pH value, and with surfactants cannot kill *M. bovis* var. *BCG* even within 45 min. at 20° C.

EXAMPLE 4

The ingredients of Formulation I are chemically stable when Part A is mixed with Part B and tap water to provide an alkaline milieu for at least 30 to 40 days at ambient temperature. Formulation I was diluted ten-fold with synthetic hard water at 400 ppm $CaCO_3$, mixing together Part A and Part B. A commercial alkaline glutaraldehyde was activated with its buffer system to pH 8.2. These disinfectants were held in a plastic tray as used to soak medical and dental instruments at ambient temperatures. The glutaraldehyde, and phenolic concentrations, and pH values were measured during 30 days. The results are shown in Table 4.

TABLE 4

| | | Concentration Percentage at Days Post-Activation | | | | |
|---|---|---|---|---|---|---|
| Disinfectant | Ingredient | Zero | 5 | 12 | 22 | 41 |
| Formulation I Diluted Ten-Fold | Glutaraldehyde | 1.59 | 1.59 | 1.58 | 1.54 | 1.52 |
| | Ortho-Phenyl phenol | 0.11 | 0.11 | 0.10 | 0.10 | 0.10 |
| | pH value | 7.5 | 7.5 | 7.4 | 7.3 | 7.2 |
| Cidex | Glutaraldehyde | 2.3 | 1.6 | 1.2 | 1.2 | 1.0 |
| | pH value | 8.7 | 8.5 | 8.3 | 8.2 | 8.1 |

Table 4 shows that Formulation I maintains a stable glutaraldehyde and phenolic concentration when brought to an alkaline pH value by the buffer system of Formulation I. In contrast, the commercial glutaraldehyde disinfectant, Cidex, loses about 50% of its original alkaline glutaraldehyde concentration within 5 to 12 days post-activation. Activation is the process of buffering the acidic glutaraldehyde to an alkaline pH value.

The above examples demonstrate that the compositions of the present invention achieve the objectives of the invention.

What is claimed is:

1. A high level disinfectant and sterilant solution useful to disinfect and sterilize heat-sensitive medical, dental and veterinary devices, comprising a two-part system for mixing just prior to use, wherein the two-part system comprises:

(a) as a first part a concentrate of from about 10.0% w/w to 25.0% w/w of glutaraldehyde, and a phenolic chemical at a concentration of 0.5% w/w to 2.2% w/w, to provide a pH of about 3.5 to 4.5; and (b) as a second and separate contained part an activated buffer form of EDTA, at a sufficient level to give the final disinfectant a buffered pH of between 7.0 and 8.5.

2. The composition of claim 1 which, as part of the first part, contains a concentration of from 15.0% w/w to 18.0% w/w of glutaraldehyde.

3. The composition of claim 2 which, as part of the first part, contains as the phenolic chemical one selected from the group consisting of ortho-phenylphenol, paratertiary amylphenol, ortho-benzyl-parachloro-phenol or other modified phenols.

4. The composition of claim 3 wherein the phenolic chemical is ortho-phenylphenol.

5. The composition of claim 4 wherein the composition of the phenolic material in the first part is from 0.5% w/w to 2.2% w/w.

6. The composition of claim 5 wherein the phenolic material is ortho-phenylphenol and the concentration-is 1.1% w/w ortho-phenylphenol.

7. The composition of claim 1 in which the first part contains a low-foaming anionic detergent.

8. The composition of claim 7 in which the first part contains sodium olefin sulfonate.

9. A method of disinfecting and sterilizing heat-sensitive medical, dental and veterinary instruments in a manner that avoids high temperatures and uses a two-part system, said method comprising:

containing as a first part a concentrate of from about 10.0% w/w to about 25.0% w/w of glutaraldehyde and a phenolic chemical at a concentration of from about 0.5% w/w to about 2.2% w/w, to provide a pH of about 3.5 to about 4.5, and containing as a second part of said disinfectant solution a separately-contained, activated buffered form of EDTA at a sufficient level to give the final disinfectant when mixed a buffered pH of between 7.0 and 8.5; and thereafter, mixing the two to provide a disinfecting and sterilant solution; and thereafter, contacting at approximately ambient conditions said disinfectant and sterilant solution just after mixing with heat-sensitive instruments for a time sufficient to sterilize and/or disinfect the same.

* * * * *